United States Patent [19]

Chang

[11] 4,342,398

[45] Aug. 3, 1982

[54] SELF-SUPPORTING PLASTIC CONTAINER FOR LIQUIDS

[75] Inventor: Long F. Chang, Sylvania, Ohio

[73] Assignee: Owens-Illinois, Inc., Toledo, Ohio

[21] Appl. No.: 197,467

[22] Filed: Oct. 16, 1980

[51] Int. Cl.[3] ..... B65D 1/02

[52] U.S. Cl. ..... 215/1 C; 220/70

[58] Field of Search ..... 215/1 C, 31; 220/70; D9/370

[56] References Cited

U.S. PATENT DOCUMENTS

| | | | |
|---|---|---|---|
| D. 92,469 | 6/1934 | Humphreys | D9/370 |
| 2,126,465 | 8/1938 | Hilgenberg | 215/31 X |
| 3,009,599 | 11/1961 | Schier et al. | 220/70 X |
| 3,272,366 | 9/1966 | Ikeda | 215/31 X |
| 3,722,726 | 3/1973 | Carmichael et al. | 215/1C |
| 4,134,510 | 1/1979 | Chang | 215/1 C |

*Primary Examiner*—Donald F. Norton

*Attorney, Agent, or Firm*—M. E. Click; D. H. Wilson, Jr.

[57] ABSTRACT

A pressure-resistant thermoplastic container has a low center of gravity and a dimensionally stable seating ring zone of substantial strength. The center of gravity is lowered by reducing the weight of the finish and neck, and using a larger diameter for the main body to reduce the overall height while maintaining the desired internal volume. The improved design of the seating ring results in a thicker wall in the bottom end and, therefore, a stronger structure. The bottom end includes a sharp V-shaped structure having a concave inside wall and a generally convex outside wall joined at the bottom ends by a return portion. A convex central portion is connected to an upper end of the inner wall to define a central cavity and an extreme lower end of the outer wall is generally concave.

9 Claims, 6 Drawing Figures

SELF-SUPPORTING PLASTIC CONTAINER FOR LIQUIDS

BACKGROUND OF THE INVENTION

1. Field of the Invention

This invention relates to the manufacture of bottles or containers of thermoplastic materials for the retention of fluids under pressure, such as carbonated beverages or the like.

2. Description of the Prior Art

Recently, various thermoplastic materials have been developed which are capable of preventing the migration of carbon dioxide ($CO_2$) therethrough and are blow-moldable into suitable container configurations. Such materials include polyethyleneterephthalate or PET; or nitrile based resins known as LOPAC, a registered trademark of Monsanto Company, or nitrile-group-containing monomers of the type disclosed in U.S. Pat. No. 3,873,660.

Such a bottle or container generally consists of a shoulder portion with a cap-receiving finish, a side wall or main body portion, and a bottom wall joined to the side wall. Pressure retaining bottles are generally of cylindrical overall contour, but the present invention is applicable to bottles of other than cylindrical contours. For purposes of simplicity of description, such terms as "cylindrical", "annular", etc. are herein utilized, but it should be understood that these terms are merely descriptive, not limiting in a geometric sense.

One primary problem which is encountered in blow-molding thermoplastic materials to form bottles or containers capable of retaining $CO_2$ and other gases under pressure resides in the provision of a bottom shape capable as serving as a bottle support while resisting deformation under pressure to thereby result in a container which is dimensionally stable. One suitable bottom shape is a simple, outwardly hemispherical shape. However, a container employing a hemispherically shaped bottom obviously requires a separately applied, outer peripheral support to enable the bottle to stand upright. A less expensive, and more practical shape results from the inversion of the outwardly hemispherical shape to an outwardly concave or "champaign bottom" shape. The transition region located at the juncture of the cylindrical bottle side wall with the inverted, concave bottom forms a seating ring upon which the bottle is supported in an upright position. Much effort has been devoted to the design of inverted, concave bottoms of this type, and many different methods and many different molds have been developed.

To reduce the creep characteristic of polymeric materials under internal pressure, the material is orientated during the bottle formation, requiring blowing at a reduced temperature. Attempts to form a concave bottom by directly inflating a parison in a blow mold of the final bottle shape have failed. Under these blowing conditions, the material simply "bridges over" the sharp curvatures required in the mold to form an adequate seating ring, and the material stretches and thins out in the region where the greatest strength is required. As a result, seating rings deform under internal pressure to reduce the seating ring diameter and to change the pressure-resistant characteristic of the concave bottom.

It has been proposed that an initially outwardly convex bottom be blown which is then inverted to form a final concave bottom. Those methods and apparatus heretofore proposed either (1) require the utilization of a separate inversion mold and reheating of the initial bottom, or (2) simply push a convex die against the outwardly convex bottom. Neither technique has solved the problems inherent in the requirements of sharp curvatures in the transition zone and of adequate material thickness at the seating ring.

One solution to the problem is disclosed in U.S. Pat. No. 4,134,510. A blowable pre-form is initially expanded against a composite mold surface defined by the end faces of a plurality of concentric tubes surrounding a central actuating rod. The rod and the tubes are initially telescopically positioned to define the composite concave surface, so that a first convex bottom is blown. Subsequently, the rod and tubes are actuated telescopically to progressively invert the convex bottom to a concave shape. The end faces of the tubes may be grooved to define reinforcing ribs in the concave bottom wall, if desired. Such a container has a concave bottom wall of improved resistance to deformation under internal pressure. This is accomplished by forming a support ring at the junction of a pair of oppositely directed inner and outer bottom walls, the juncture of the wall defining an included angle which is equal to or less than 90° and the internal radius of the support ring which is equal to or less than four times the thickness of the walls.

One problem with push-up type freestanding containers under internal pressure is that the inside wall joining the seating ring has a tendency to roll out and the radius of the seating ring tends to shrink such that the bottom tends to grow longer. In the extreme case, the deformation due to the internal pressure leads to rocker bottom. The deformation is mainly caused by a low bending moment at the seating ring area, and, as a result, requires a thicker wall in the seating ring area to resist such deformation. The inability to distribute more material in the seating ring region in the formation of an oriented container is the main reason that a large functional seating ring is difficult to fabricate.

SUMMARY OF THE INVENTION

The present invention provides a pressure-resistant thermoplastic container having a low center of gravity and a dimensionally stable seating ring zone of substantial strength. The center of gravity of the container is lowered by reducing the weight of the finish and neck, and using a larger diameter for the main body of the container to reduce the overall height while maintaining the desired internal volume. A further advantage of the large cylindrical main body is that a uniformly high degree of stretch ratio, and hence orientation, can be obtained to enhance the mechanical strength and barrier properties of the container. The improved design of the seating ring results in a thicker wall in the bottom end and, therefore, a stronger structure. The strength increase is realized by using a sharp V-shaped structure characterized by a concave inside wall and a generally convex outside wall having a concave extreme lower end joining the seating ring and a convex center of the bottom of the container.

It is an object of the present invention to provide a beverage container with an improved surface-to-volume ratio to increase carbonation retention.

It is another object of the present invention to provide a beverage container with a low center of gravity to increase the stability angle.

It is a further object of the present invention to provide a beverage container having increased strength in the seating ring zone.

It is another object of the present invention to provide a beverage container having a bottom wall structure which reduces the blow molding pressure required for formation.

DESCRIPTION OF THE PREFERRED EMBODIMENT

Figure 1:
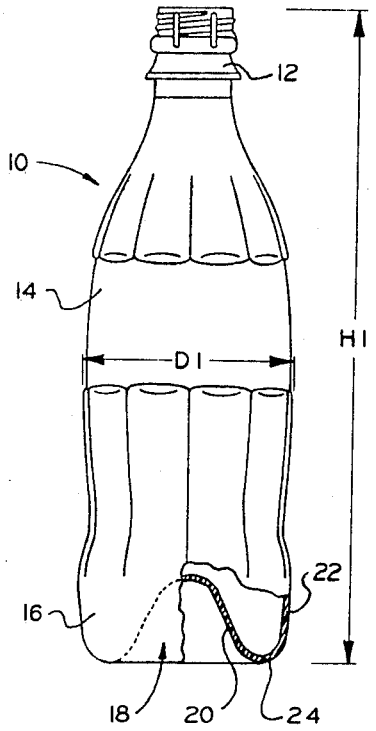
FIG. 1 (PRIOR ART)
FIG. 1 is a front elevational view of a prior art thermoplastic container with a portion of the seating ring zone broken away to more clearly illustrate the structure.
Figure 2:
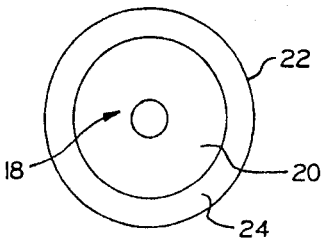
FIG. 2 (PRIOR ART)
FIG. 2 is a bottom plan view of the container shown in FIG. 1.

There is shown in FIGS. 1 and 2 a prior art container 10 in the form of a bottle. The bottle is formed of a thermoplastic material having gas barrier properties sufficient to contain a carbonated beverage for an expected shelf life. The bottle is blow molded from an extruded or injection molded pre-form or parison and has preferably been so worked that the material is biaxially orientated. The bottle 10 has an upper neck portion 12 having a suitable neck finish, such as threads for receiving a threaded cap (not shown). The upper neck portion 12 blends into a body portion 14 of cylindrical configuration. The lower end of the cylindrical body section blends into a bottom wall structure 16 which closes the bottom of the bottle.

The lower end of the bottom wall structure 16 includes a central cavity 18 defined by an inner wall 20. An outer wall 22 is joined with the inner wall 20 by a return portion 24 defining a seating ring.

For a typical half liter bottle, the central cavity 18 is approximately one inch deep, the height H1 is approximately 8.25 inches, and the major diameter D1 is approximately 2.76 inches.

Figure 3:
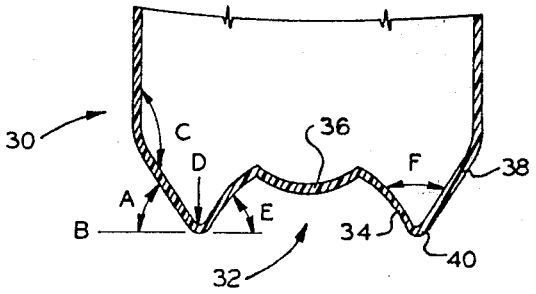
FIG. 3 (PRIOR ART)
FIG. 3 is a fragmentary sectional view of the seating ring portion of a second prior art thermoplastic container.

There is shown in FIG. 3 a fragmentary sectional view of the seating ring portion of an improved container having a bottom wall of enhanced pressure-resistant characteristics which is disclosed in U.S. Pat. No. 4,134,510. A bottom wall structure 30 includes a central cavity 32 defined by a concave inner wall 34 extending upwardly to a depressed convex central portion 36. The inner wall 34 is joined to an outer wall 38 by a return portion 40 defining a seating ring. The compound concave-convex shape of the bottom wall structure has the advantage of not reducing the capacity of the bottle.

The wall 38 may be defined as having a slope angle A of 45° or more with respect to the horizontal B. Alternatively, the slope Angle A of the wall 38 may be defined with reference to the side wall of the bottom wall structure 30 as an included angle C of at least 135°. The relatively great steepness of the slope angle A increases the rigidity of this wall against bending under pressure generated internally of the container. The lower side wall 38 need not be conical, but the radius should be as great as possible so as to approach a conical configuration.

The seating ring region 40 has a radius of curvature which is as small as possible. This radius of curvature may be defined as the ratio of the radius of curvature D to the wall thickness of the container bottom, and this ratio should be as small as possible and preferably less than four. In other words, the radius of curvature of the porton 40 is not more than four times the average wall thickness of the container bottom. The slope angle E of the concave portion 34 is also as great as possible to enhance bending resistance in this region. Again, a slope angle of at least 45° is preferred. Finally, the included angle F between the slope angle of the outer wall 38 and the slope angle of the inner wall 34 is preferrably less than 90°, again, to increase the bending resistance.

Figure 4:
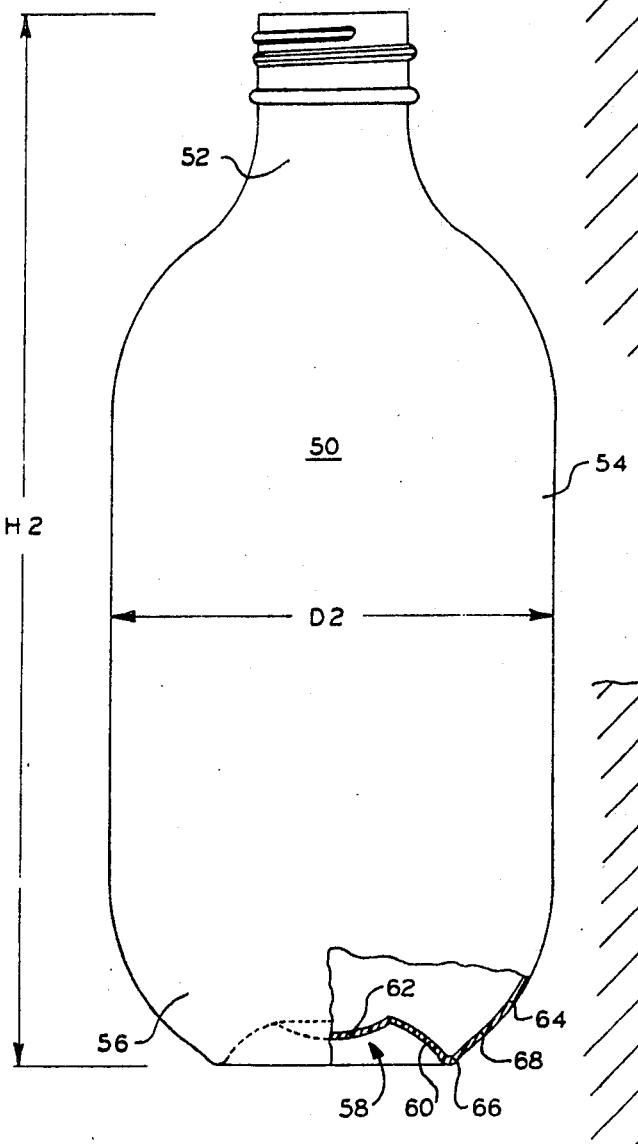
FIG. 4 is a front elevational view of a thermoplastic container formed according to the present invention with a portion of the seating ring zone broken away to more clearly illustrate the invention.

There is shown in FIG. 4 a container 50 formed according to the present invention. The bottle 50 has an upper neck portion 52 having a suitable neck finish, including threads for receiving a threaded cap (not shown). The upper neck portion 52 blends through a shoulder region into a body portion 54 of generally cylindrical configuration. The lower end of the cylindrical body section blends into a bottom wall structure 56 which closes the bottom of the bottle.

The bottom wall structure 56 includes a central cavity 58 defined by a concave inner wall 60. The inner wall 60 extends upwardly to a depressed convex central portion 62. An outer wall 64 is joined to the inner wall 60 by a return portion 66 which defines the seating ring. However, the bottom wall structure 56 differs from the bottom wall structure 30 shown in FIG. 3 in that an extreme lower end 68 of the outer wall 64 is concave where it joins the return portion 66.

The container 50 has further differences from the prior art containers shown in FIGS. 1–3. The center of gravity of the container 50 is maintained as low as practical. This is achieved by reducing the weight of the finish and the neck, and using a larger diameter for the main body of the container to reduce the overall height. Furthermore, the material in the finish, neck, and shoulder regions is minimized. A typical upper neck or finish used in the container shown in FIG. 1 weighs about six grams while a light-weight finish according to the present invention weighs as low as two grams. In order to further reduce the center of gravity, the material or wall thickness in the neck and shoulder region is redistributed to the lower portion of the container. The main body diameter D2 is approximately 2.9 inches as compared with the 2.76 inch diameter D1 of the container shown in FIG. 1. This increase in main body diameter allows the height H2 to be reduced to 6.73 inches from the 8.25 inch height H1 of the prior art container for the half liter size bottle. These changes also reduce the total area of the package by approximately ten percent to reduce the surface-to-volume ratio and carbonation loss.

A further advantage of using a relatively large cylindrical main body for the container is that a uniformly high degree of stretch ratio, and hence orientation, can be obtained to enhance the mechanical strength and barrier properties. The stability angle, the angle with respect to vertical at which the container will tip over, is increased from approximately 10° in the container shown in FIG. 1 to approximately 14° in the improved container according to the present invention.

Figure 5:
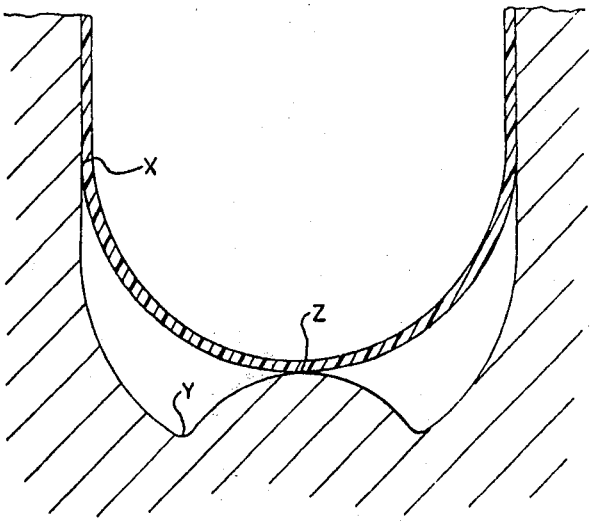
FIG. 5 (PRIOR ART)
FIG. 5 is a fragmentary sectional view of the final stage of the bottom formation of a prior art thermoplastic container of the type shown in FIG. 1.
Figure 6:
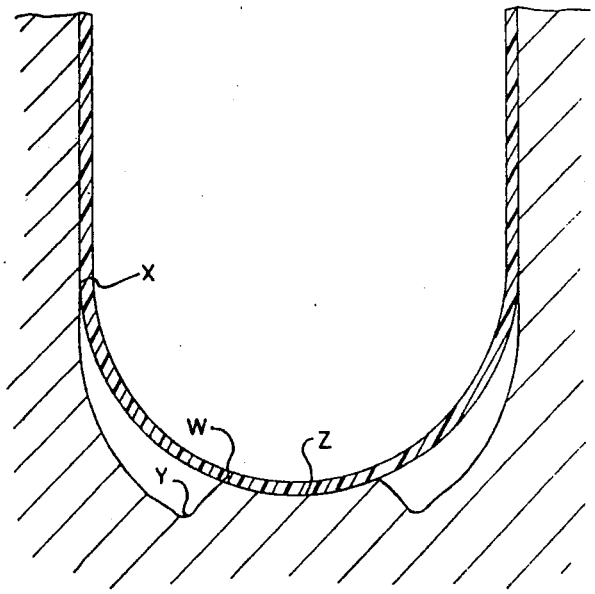
FIG. 6 is a fragmentary sectional view of the final stage of the bottom of a thermoplastic container according to the present invention.

The success of fabricating a functional push-up type free-standing bottom depends, in part, on the ability to force material in the vicinity of the seating ring to improve strength against bending caused by the internal pressure. FIG. 6 shows an improved push-up structure by which the material distribution in the vicinity of the seating ring can be increased over a conventional push-up bottom as shown in FIG. 5. There is shown in FIGS. 5 and 6 the configurations of the forming bubble and the blow mold in the final stage of bottle formation. In the prior art bottle shown in FIG. 5, the forming bubble material between the points X and Z will be distributed along the walls X-Y-Z of the mold. As shown in FIG, 6, the material in the forming bubble between the points X and Z will be distributed along the walls X-Y-W-Z with the area between the points W and Z previously formed. As can be seen, the unformed distance in FIG. 5 is greater than the unformed distance in FIG. 6 and, therefore, the bottom of the bottle in FIG. 6 will have thicker walls resulting in a stronger structure.

The strength of the push-up type freestanding bottom is determined not only by the wall thickness, but also by the geometrical configuration in that region. For a given wall thickness profile or material distribution, the steeper the angle of the inner and outer walls joining the seating ring, the stronger the structure will be. Therefore, the improved design according to the present invention utilizes outwardly concave walls at the extreme lower end 68 to join the seating ring to the outer wall 64. Such a configuration improves the strength of the bottom at elevated temperatures.

In accordance with the provisions of the patent statutes, the principle and mode of operation of the present invention have been explained and illustrated in its preferred embodiment. However, it must be understood that the invention may be practiced otherwise as specifically illustrated and described without departing from its spirit or scope.

What is claimed is:

1. In a bottle for the retention of fluids under pressure, having a neck portion, a bottom portion and a side wall interconnecting the neck portion and the bottom portion, the bottom portion comprising: an inner wall defining a central cavity; a generally convex outer wall; a return portion joining lower ends of said inner wall and said outer convex wall to define a seating ring with the extreme lower end of said outer wall adjacent said return portion being concave.

2. The bottom portion defined in claim 1 wherein said inner wall is generally concave.

3. The bottom portion defined in claim 1 wherein said outer wall above said extreme lower end is generally convex.

4. The bottom portion defined in claim 1 including a convex central portion connected to an upper end of said inner wall to define said central cavity.

5. The bottom portion defined in claim 1 having a wall thickness greater than the wall thickness of the neck portion of the bottle.

6. In a bottle for the retention of fluids under pressure, having a neck portion, a bottom portion and a side wall interconnecting the neck portion and the bottom portion, the bottom portion comprising: an inner concave wall; a convex central portion connected to an upper end of said inner wall, said inner wall and said central portion defining a central cavity; a generally convex outer wall interconnecting said inner wall with said side wall; a return portion joining the adjacent lower ends of said inner wall and said outer wall to define a seating ring with the extreme lower end of said outer wall adjacent said return portion being generally concave.

7. The bottom portion defined in claim 6 having a wall thickness greater than the wall thickness of the neck portion of the bottle.

8. A bottle for the retention of fluids under pressure, having a neck portion, a bottom portion and a side wall interconnecting the neck portion and the bottom portion wherein said bottom portion includes an inner wall defining a central cavity; an outer wall; a return portion joining lower ends of said inner wall and said outer wall to define a seating ring; and an extreme lower end of said outer wall being generally concave.

9. The bottle defined in claim 8 wherein said inner wall is concave and said outer wall above said extreme lower end is generally convex and including a convex central portion connected to an upper end of said inner wall, said inner wall and said central portion defining a central cavity.

* * * * *